US005689827A

United States Patent [19]

Ryder

[11] Patent Number: 5,689,827

[45] Date of Patent: Nov. 25, 1997

[54] FASTENER ASSEMBLIES FOR COMBINATION VISOR AND EYESHIELD

[76] Inventor: Curtis J. Ryder, 9 Bitterblue La., San Antonio, Tex. 78218

[21] Appl. No.: 615,773

[22] Filed: Mar. 13, 1996

[51] Int. Cl.[6] ..... A42B 1/06

[52] U.S. Cl. ..... 2/10; 2/453; 2/209.13; 351/155

[58] Field of Search ..... 2/175.1, 195.1, 2/10, 13, 453, 6.5, 12, 209.13, 209.12; 351/155, 158

[56] References Cited

U.S. PATENT DOCUMENTS

| | | | |
|---|---|---|---|
| 1,696,198 | 12/1928 | Gross | 2/10 |
| 1,833,741 | 11/1931 | Diehl | 2/10 |
| 2,481,960 | 9/1949 | Wall et al. | 2/10 |
| 2,500,280 | 3/1950 | Feldman | 2/10 |
| 2,538,607 | 1/1951 | Vaca | 2/10 |
| 2,538,608 | 1/1951 | Vaca | 2/10 |
| 2,549,445 | 4/1951 | Friess | 2/10 |
| 2,619,641 | 12/1952 | Vaca | 2/10 |
| 2,648,091 | 8/1953 | Jones | 16/140 |
| 2,654,089 | 10/1953 | Tannenbaum | 2/10 |
| 2,725,560 | 12/1955 | Feldman | 2/10 |
| 4,541,125 | 9/1985 | Phillips | 2/10 |
| 4,819,274 | 4/1989 | Day | 2/10 |
| 4,951,316 | 8/1990 | Moody | 2/10 |
| 5,056,164 | 10/1991 | Lisle et al. | 2/453 |
| 5,129,102 | 7/1992 | Solo | 2/10 |
| 5,261,124 | 11/1993 | Day | 2/10 |
| 5,412,812 | 5/1995 | Gatchalian | 2/10 |
| 5,533,207 | 7/1996 | Diaz | 2/453 |

FOREIGN PATENT DOCUMENTS

| | | | |
|---|---|---|---|
| 158859 | 6/1952 | Australia | 2/10 |

*Primary Examiner*—Amy B. Vanatta
*Attorney, Agent, or Firm*—Gunn, Lee & Miller

[57] ABSTRACT

Various fasteners for connecting an eyeshield to the underside of a cap visor. In general, the fasteners contain one or more bases attached to the underside of the visor. A connector engages the base in such a way as to remain in a fixed position unless adjusted by the wearer. The eyeshield is pivotally coupled to the connector to enable its movement from an inoperative position parallel to the visor to an operative position perpendicular to the visor. The eyeshield may be fixed at any location between these two positions. The eyeshield may also be moved in a longitudinal direction nearer to or further from the wearer's face.

16 Claims, 3 Drawing Sheets

FASTENER ASSEMBLIES FOR COMBINATION VISOR AND EYESHIELD

BACKGROUND OF THE INVENTION

1. Field of the Invention

The present invention relates generally to a combination visor and eyeshield. More particularly, the invention relates to various fastener mechanisms used to attach the eyeshield to the visor of a cap or hat.

2. Description of the Related Art

Various cap and eyeshield or sunshade combinations have been provided wherein the eyeshield is movably mounted on the underside of the cap visor to allow the eyeshield to be flipped up parallel to the visor when it is not in use and flipped down from the visor when protection of the eyes is needed. Caps and hats equipped with such movable sunshades are known and have use in a variety of working and sporting activities. Cap and eyeshield combinations have also been provided which allow longitudinal adjustment of the eyeshield to control the distance of the eyeshield from the wearer's face when in use. An example of a combination cap and eyeshield which employs this longitudinal movement is U.S. Pat. No. 2,654,089 issued in 1953 to Tannenbaum.

A crucial component of the combination cap and eyeshield is the specific way in which the eyeshield is fastened to the visor. The specific implementation of any given fastener directly controls a variety of factors regarding the actual use of the device. In particular, the fastener mechanism determines the ease with which the eyeshield may be moved relative to the cap visor, the positions which the eyeshield may assume relative to the cap visor, whether the eyeshield may be moved longitudinally relative to the wearer's face, the security the eyeshield has for remaining in any given position selected by the user, and the functional lifetime of the cap and eyeshield combination.

In the past, a number of different types of fasteners have been proposed for attaching eyeshades to the visor of a cap. The majority of these use a "ball and socket" type fastener to provide the connection. U.S. Pat. No. 2,648,091 issued in 1953 to Jones discloses a socket member attached to the underside of a cap visor. The socket member has two parallel sidewalls, each containing aligned openings spaced from each other to provide a series of pairs of opposing openings which receive a stud connected to an eyeshield. The stud is snapped into the desired pair of opposing openings, thereby allowing the user to adjust the longitudinal distance of the eyeshield from the user's face. Once the stud is snapped into a pair of openings, the stud rotates within the openings thereby allowing movement of the eyeshield between operative and inoperative positions.

U.S. Pat. No. 2,654,089 issued in 1953 to Tannenbaum discloses another ball and socket fastener. The stud described is suspended from a circular, flat base via a neck such that the base is capable of sliding within a track mounted on the underside of the cap visor. Again, longitudinal movement of the eyeshield is effected by sliding the base along its track to move the stud nearer to or further from the wearer's face. The eyeshield is connected to the stud via a pair of parallel ears containing concave portions into which the stud is snapped. The eyeshield can thus be rotated about the stud.

Another common means of fastening an eyeshield to a cap visor is through a pin which snaps into a grove located in a housing. U.S. Pat. No. 4,819,274 issued in 1989 to Day discloses a mounting block which is attached to the underside of the cap visor. The mounting block contains a groove wherein a pin-type member located on the upper frame of the eyeshield may be snapped. The eyeshield may then be rotated about an axis formed by the pin and the groove. Friction between the mounting block and the pin holds the eyeshield in the position selected by the user.

U.S. Pat. No. 5,412,812 issued in 1995 to Gatchalian discloses a clip-type mounting base which may be removably attached to the underside of a cap visor. The base consists of two horizontal, parallel arms separated by a flat, horizontal space through which a tightening screw is vertically passed. At the end of the two arms the space is hollowed out to form a horizontal groove into which a horizontal pin member attached to a pivotal eyeshield holder is inserted. The eyeshield is then adjusted to a desired position, and the screw is tightened so that the two arms of the base hold the eyeshield in place.

Although fasteners are presently available which are capable of connecting an eyeshield to a visor so as to permit movement of the eyeshield from a vertical, operative position to a horizontal, inoperative position, other types of fasteners may be employed. In addition, many of the known fasteners, especially the ball and socket type, are subject to damage from repeated adjustment of the eyeshield. In particular, the many moving parts associated with the ball and socket type fasteners tend to wear out through repeated use, and the "socket" often loosens so that it cannot provide enough friction against the "ball" to hold the eyeglasses in a desired position.

SUMMARY OF THE INVENTION

The present invention seeks to overcome the drawbacks and disadvantages of the prior art by providing a fastener for a combination visor and eyeshield which has simple construction and minimal parts yet securely holds the eyeshield in its desired position. The invention comprises a base attached to the underside of a visor. Engaging the base is a connector which remains in a fixed position relative to the base unless moved by the wearer. The eyeshield is pivotally coupled to the connector to enable the eyeshield to be moved from an inoperative location parallel to the visor to an operative position perpendicular to the visor. The eyeshield may also be fixed at any location between these two positions. The eyeshield may also be moved longitudinally nearer to or further from the wearer's face.

It is therefore an object of this invention to provide a fastener for attachment of a moveable eyeshield to a visor that is simple in its design and construction, yet functions as desired by the user.

It is an additional object of the present invention to provide a fastener for attaching an eyeshield to a visor that does not prematurely wear out due to repeated use.

It is a further object of the present invention to provide a fastener for attaching an eyeshield to a visor which will hold the eyeshield in a fixed position selected by the user.

Yet another object of the present invention is to provide various fasteners for attaching an eyeshield to a visor so as to allow movement of the eyeshield relative to the visor.

Still other objects and advantages of the present invention will become readily apparent to those skilled in this art from the following detailed description, wherein multiple preferred embodiments of the invention are shown and described, simply by way of illustration of the best mode contemplated by the inventor for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION OF THE PREFERRED EMBODIMENTS

Figure 1:
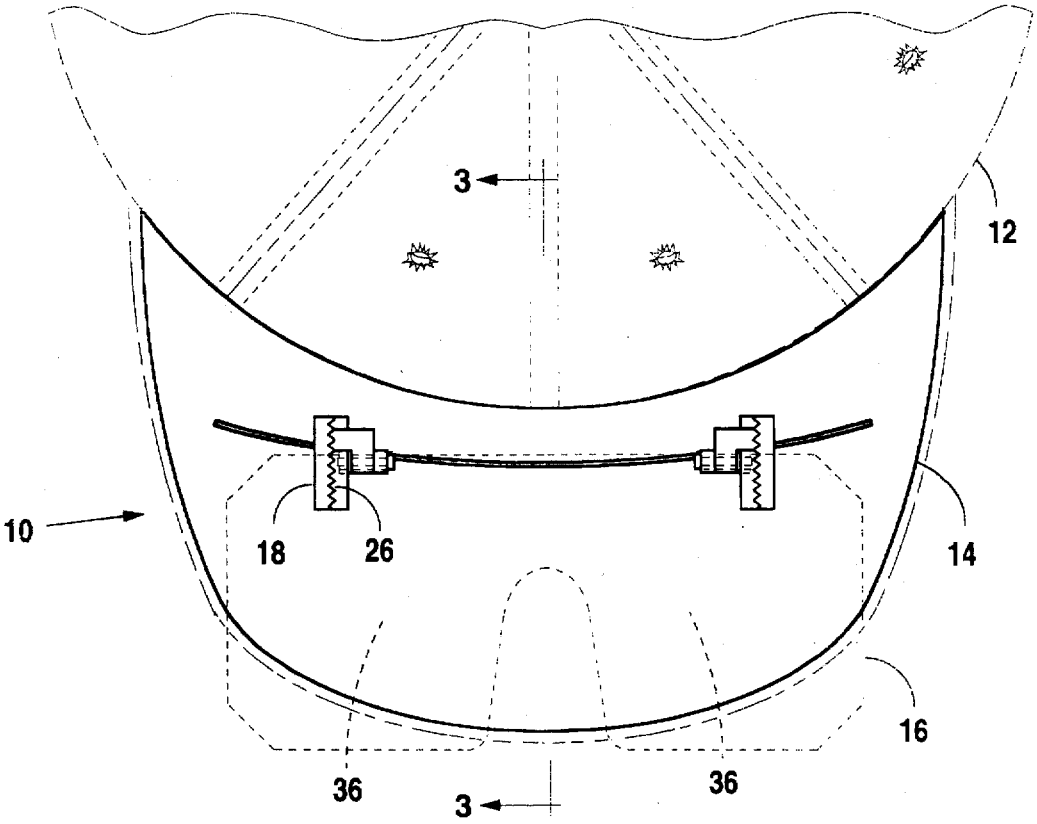
FIG. 1 is a top view of a combination cap, visor and eyeshield illustrating a preferred embodiment of a fastener used to attach an eyeshield (shown in outline) to the underside of a cap visor.
Figure 2:
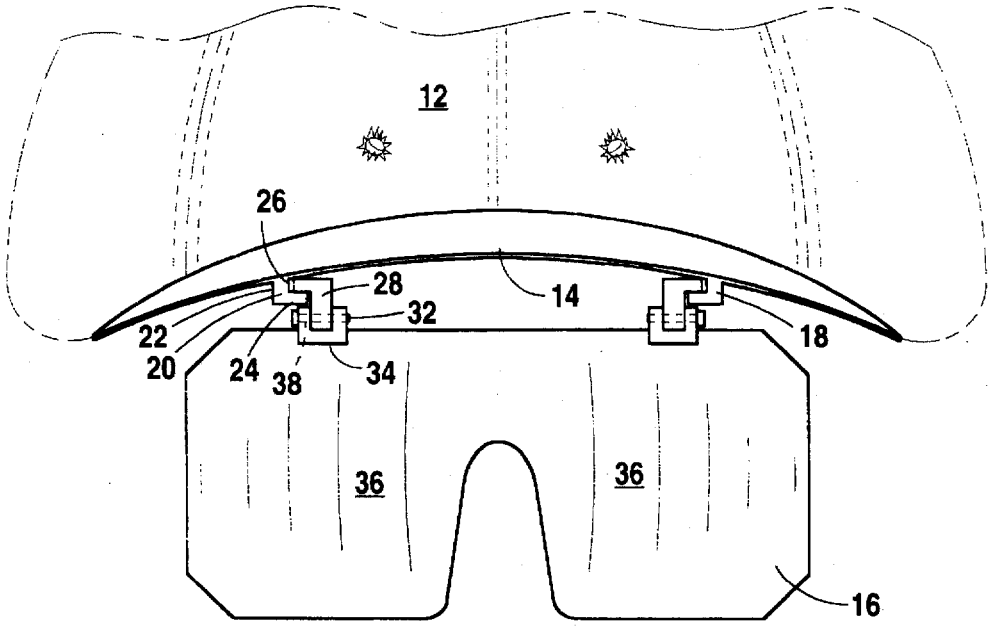
FIG. 2 is an elevational view of the eyeshield and visor combination depicted in FIG. 1.
Figure 3:
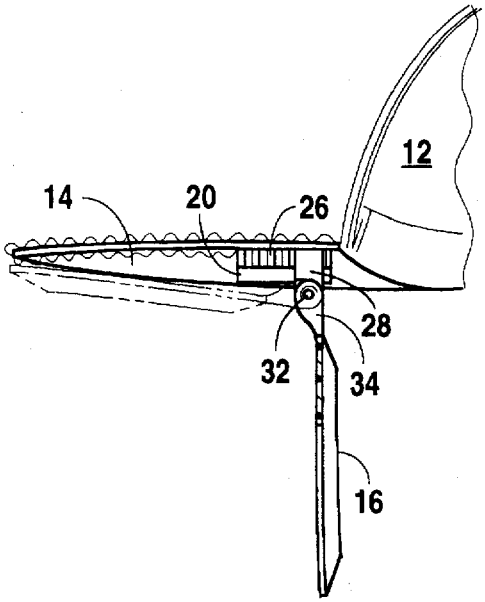
FIG. 3 is a cross-sectional view of FIG. 1 taken along the line 3—3.

Reference is made to FIGS. 1 to 3 for a detailed description of a first embodiment of the fastening device of the present invention. FIG. 1 shows a cap and eyeshield combination (10). The cap or hat (12) has attached to it a brim or visor (14) to assist in blocking overhead light from direct contact with the wearer's eyes. To further assist in reducing the amount of ambient light incident to the wearer, a pair of eyeshields (16) are mounted on the underside of the visor (14) via a pair of fasteners (18). The fasteners (18) permit rotation of the eyeshield (16) between an operative position perpendicular to the visor (14) (depicted in FIG. 2) and an inoperative position parallel and adjacent to the visor (14) (shown in FIG. 1). The fastener (18) also enables longitudinal movement of the eyeshield (16) so as to vary the distance between the eyeshield (16) and the wearer's face. The fastener (18) is connected to both the visor (14) and the eyeshield (16).

In the first embodiment, the fastener (18) is made of several components. A base (20) is attached to the underside of the visor (14) such as by sewing or riveting. The base (20) has an L-shape to its cross-section when viewed along its length axis. The upper leg (22) of the base (20) is physically attached to the visor (14) as previously described. The lower leg (24) of the base (20) forms a right angle with the upper leg to create the "L". The interior surface (26) of the upper leg (22) is corrugated to form a number of alternating teeth and indentations. The teeth and indentations may be formed through right angles like cogs in a gear, or they may form alternating triangular points. The interior surface (26) of the upper leg (22) may alternatively contain rounded indentations. An inverted, L-shaped connector (28) rests on the upper surface of lower leg (24) of the base (20) so as to contact the interior surface (26) of the upper leg (22). The surface of the L-shaped connector (28) which contacts the toothed surface (26) of the base (20) contains at least one tooth which is shaped to integrally fit within any of the indentations located on surface (26). The L-shaped connector (28) may contain more than one tooth and indentation. It is designed to mirror, and thus exactly fit into, the toothed surface (26) of the upper leg (22). Through this connection, the base (20) and the connector (28) are prevented from sliding relative to each other. The vertical leg (29) of the L-shaped connector (28) provides a connection point for the fastener (18) to the eyeshield (16).

In the preferred embodiment, the vertical leg (29) of the L-shaped connector (28) contains a passage through it which is parallel to the longitudinal axis of the eyeshield (16). This passage (not shown) is designed to accept a pin (32). The vertical leg (29) of the L-shaped connector (28) is first seated within a generally U-shaped pivot member (34) which also contains aligned passages (not shown) through the two upper arms (38) of the pivot member (34). The vertical leg (29) of the L-shaped connector (28) is seated between the two arms (38) of the pivot member (34) such that the passages are aligned. The pin (32) is then placed through the passages, thereby attaching the L-shaped connector (28) to the pivot member (34) so as to allow them to be rotated relative to one another along the axis provided by the pin (32). The base of the pivot member (34) contains an open passage, or slit (not shown) into which the top edge of the eyeshield (16) is inserted. While the eyeshield (16) is securely held by the pivot member (34), the addition of glue or any other permanent connection means used in the art may be used to insure a secure connection between the pivot member (34) and the eyeshield (16). By way of this pivoting connection, the eyeshield (16) may be rotated through a variety of positions between an operative location generally perpendicular to the visor (14) and an inoperative location generally parallel to the visor (14).

The fastener (18) thus described connects the eyeshield (16) to the cap visor (14) so as to allow longitudinal movement of the eyeshield (16) along the length of the base (20) as well as pivotal movement of the eyeshield (16) relative to the cap visor (14) along the axis provided by the pin (32). While one such fastener (18) may suffice, the preferred embodiment employs two identical fasteners (18), with each fastener (18) located approximately above each eye cover (36). The position of the second fastener (18) is reversed relative to the first so as to bias the contact between each fastener's base (20) and L-shaped connector (28) along their respective toothed surfaces. The flexibility of the cap visor (14) as well as a spring bias surrounding the pin (32) allows the fasteners (18) to be adjusted by the user along the toothed surface (26) when desired yet remain securely located at the position selected by the user.

Figure 5:
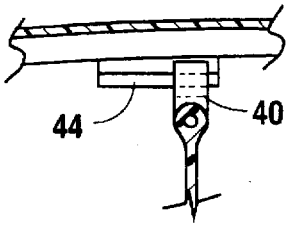
FIG. 5 is a partial, cross-sectional view of the fastener of FIG. 4 taken along line 5—5.
Figure 4:
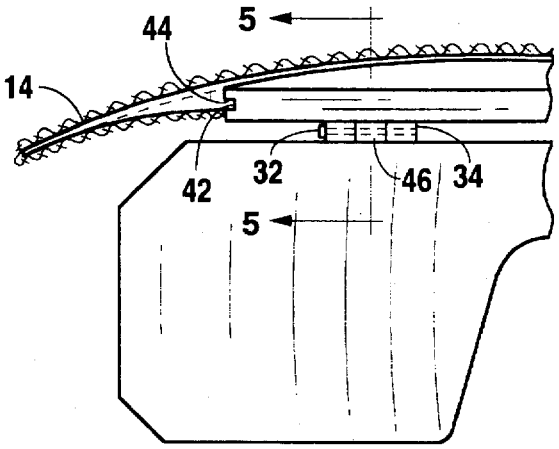
FIG. 4 is a sectional elevation of a second embodiment of the fastener of the present invention.
Figure 6:
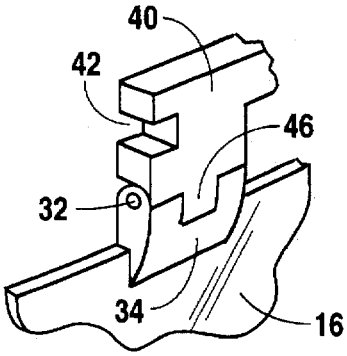
FIG. 6 is a partial perspective view of the fastener of FIG. 4.

FIGS. 4, 5, and 6 disclose a second preferred embodiment for the fastener (18) of the current invention. In this embodiment, a bar (40) containing a groove (42) at each of its distal ends (best seen in FIG. 6) is attached to the underside of a visor (14) through corresponding mating tabs (44) located within the visor. The bar (40) is semi-rigid and made out of a suitable material such as plastic, wood or metal such that it has some flexibility for installation within the visor. The mating tab (44) has a width greater than the cross-sectional width of the bar (40) to permit the bar (40)

to slide along the mating tab (44) to vary the distance between the eyeshield (16) and the user's face as desired by the user. Depending from the bar (40) a distance from the groove (42) is hook (46) through which a passage (not shown) parallel to the length of the bar (40) has been made. The hook (46) engages a notch formed by a generally U-shaped member (34) similar to the U-shaped member (34) previously described in the first embodiment. The U-shaped member (34) is connected to the eyeshield (16) in a similar fashion as previously described. A pin (32) is passed through the apertures in the U-shaped member (34) and the passage in the hook (46) to secure the bar (40) to the eyeshield (16). The connection of the bar (40) with the eyeshield (16) in this fashion thus permits the position of the eyeshield (16) to be determined by the user as previously described herein.

Figure 8:
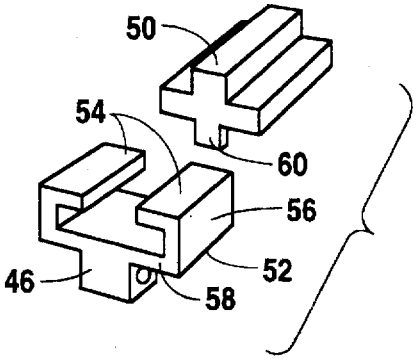
FIG. 8 is a partial exploded perspective view of the fastener of FIG. 7.
Figure 7:
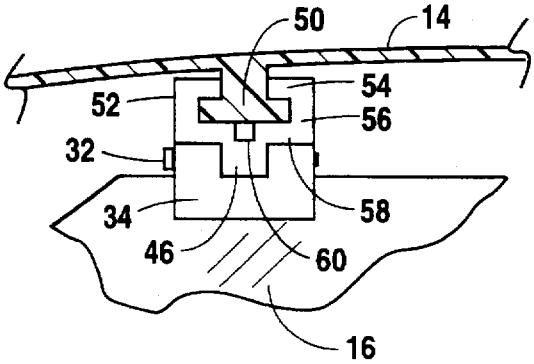
FIG. 7 is a sectional elevation view of a third embodiment of the fastener of the present invention.

FIGS. 7 and 8 illustrate a third embodiment of the fastener of the present invention. A generally T-shaped base (50) is mounted upside down to the underside of the cap visor (14) in a permanent fashion, such as by sewing, riveting, or adhering. The base (50) is installed on the visor (14) so that its length is generally perpendicular to the surface of the wearer's face. Slidably mounted to the base (50) is a track member (52). The track member (52) contains two opposing top walls (54), two side walls (56), a base (58) and a hook (46) which combine to form an inverted T-shaped chamber in the track member (52) into which the T-shaped base (50) fits. The hook (46) of the track member (52) is connected via a pin (32) to the eyeshield (16) through a U-shaped pivot member (34) and functions as previously described above. The eyeshield (16) may thus be moved longitudinally along the T-shaped base (50) to adjust the distance of the eyeshield (16) from the wearer's face. At each end of the T-shaped base (50) is located a stop (60) which prevents the track member (52) from sliding completely off of the T-shaped base (50). The dimensions of the T-shaped base (50) and the chamber within the track member (52) are such that friction between the T-shaped base (50) and the track member (52) prevents the track member (52) from moving along the T-shaped base (50) during normal use of the combination visor and eyeshield. However, upon force applied by the wearer to the fastener, the track member (52) can be adjusted in its position along the T-shaped base (50). Again, while one such fastener will suffice for the proper operation of the visor (14) and eyeshield (16), the preferred embodiment employs two fasteners, one over each eye covering of the eyeshield (16).

Figure 9:
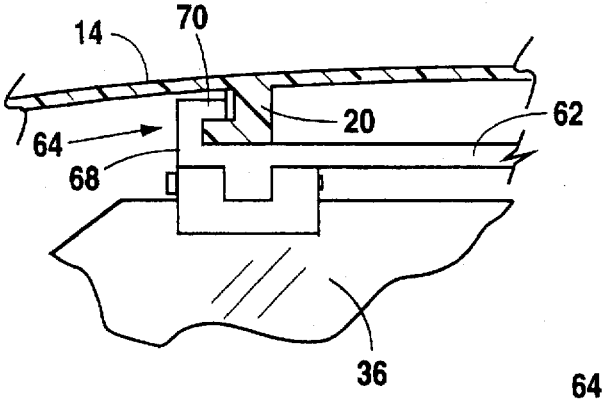
FIG. 9 is a partial elevational view of a fourth embodiment of the fastener of the present invention.
Figure 10:
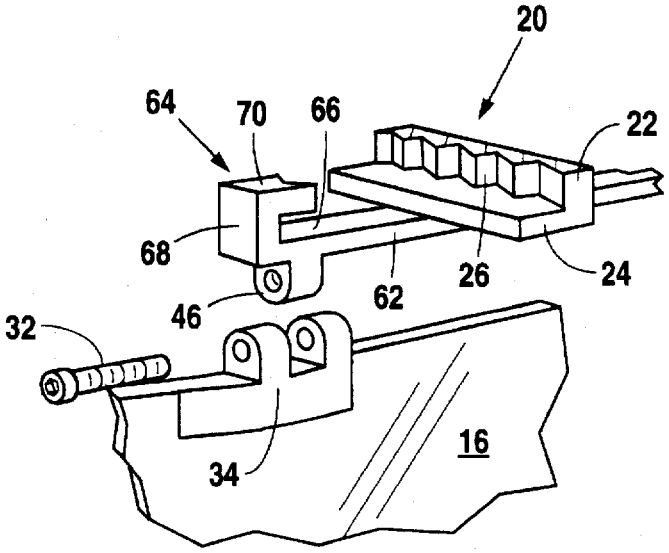
FIG. 10 is a partial exploded view of the fastener of FIG. 9.

FIGS. 9 and 10 show a fourth embodiment of the fastener (18) of the invention. It employs an L-shaped base (20) having an upper leg (22) and a lower leg (24) as described previously. The base (20) is attached to the underside of a cap visor (14) with the length of the base (20) oriented in a direction perpendicular to the surface of the cap wearer's face. On the inside surface (26) of the upper leg (22) are alternating teeth and indentations as previously described in conjunction with the first embodiment. This embodiment also employs a horizontal bar (62) running in a direction generally parallel to the surface of the wearer's face. The bar (62) terminates at each end in a U-shaped contact (64). The center channel (66) of the U-shaped contact (64) is formed by the bar (62), a side wall (68) which extends vertically from the bar (62) and a top wall (70) perpendicular to the side wall (68) and parallel to the bar (62). The exposed end of the top wall (70) contains at least one tooth and indentation which correspond to the teeth and indentations on surface (26) of the L-shaped base (20). When the eyeshield (16) is attached to the visor (14), both sets of teeth and indentations come into contact to prevent the bar (62) from sliding relative to the L-shaped base (20). The lower leg (24) of base (20) slides within the center channel (66) of the U-shaped contact (64) to provide additional support to the fastener.

Depending from the bar (62) is a hook (46) which fits into a U-shaped pivot member (34) to allow rotation about a pin (32) as previously described. In the preferred embodiment, there are two such fasteners (18), each being connected to the eyeshield (16) above each eye covering (36). The eyeshield (16) can be rotated from an inoperative position parallel to the visor (14) to an operative position in front of the wearer's eyes and generally perpendicular to the visor (14). The eyeshield (16) may also occupy any position between these two described positions. Further, the distance of the eyeshield (16) from the wearer's face may be varied by adjusting the placement of the bar (62) relative to the L-shaped base (20) at the U-shaped contact (64). Once positioned by the user, the eyeshield (16) remains at its position until moved by the user.

Figure 11:
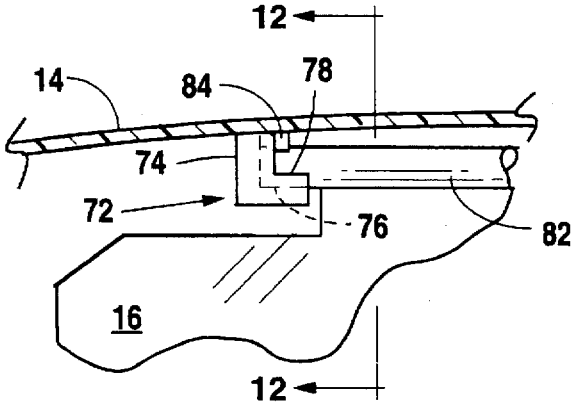
FIG. 11 is a partial elevational view of a fifth embodiment of the fastener of the present invention.
Figure 12:
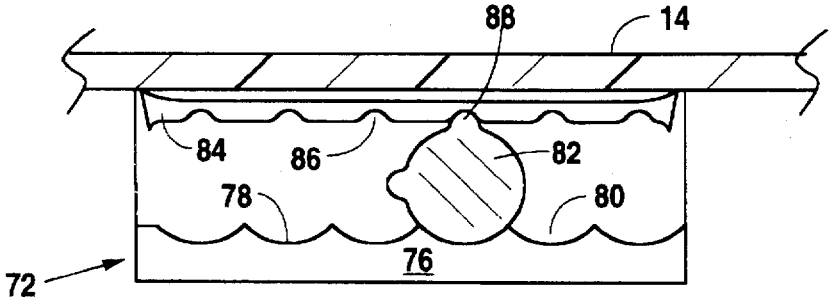
FIG. 12 is a partial, cross-sectional view of the fastener of FIG. 11 taken along line 12—12.

FIGS. 11 and 12 illustrate a final embodiment of a fastener for a combination visor (14) and eyeshield (16). Depending from the underside of the visor (14) is an L-shaped base (72) having an upper leg (74) and a lower leg (76). The L-shaped base (72) is connected to the underside of the visor (14) along the top surface of the upper leg (74) as previously described. The top surface (78) of the lower leg (76) contains a series of cylindrical indentations (80) best seen in FIG. 12. Placed within one of the indentations (80) of the L-shaped base (72) is one end of a rounded bar (82). Attached along the longitudinal length of the bar (82) is the eyeshield (16). The other end of the bar (82) rests in an indentation in a similar, but oppositely positioned, L-shaped base (not shown) attached near the opposite end of the visor (14). The second L-shaped base is attached to the visor (14) so that each of its indentations are aligned with an indentation (80) in the first L-shaped base (72). In this way, the eyeshield (16) is connected to the visor (14) to enable adjustment of the distance between the eyeshield (16) and the wearer's face. This adjustment is accomplished by placing the bar (82) in a different pair of aligned indentations (80) located either closer to or further away from the wearer's face.

At each end of the rounded bar (82) are at least two teeth (88) located on the outer surface of the bar (82). The teeth (88) are positioned approximately 90 degrees apart. Each tooth (88) engages a keeper bar (84) positioned opposite the top surface (78) of the lower leg (76) and adjacent the underside of the visor (14). The keeper bar (84) runs parallel to the length of the L-shaped base (72). The keeper bar (84) is typically composed of spring metal which is biased away from the visor (14) and toward the lower leg (76). The keeper bar (84) contain a plurality of notches (86) along its length into which a tooth (88) on the bar (82) can be positioned. Each notch (86) corresponds to an indentation (80) and aids in holding the bar (82), and thus the eyeshield (16), a set distance from the wearer. By rotating the bar (82) about its longitudinal axis, the specific tooth (88) engaging the keeper bar (84) may be varied. In this way, the eyeshield (16) may be moved back and forth between an inoperative and an operative position. Additional teeth (88) may be located on the bar (82) to provide more positions into which the eyeshield (16) may be locked. Besides metal, the keeper bar (84) may be composed of plastic or any other flexible, yet resilient, material. Instead of having teeth (88) as herein described, the rounded bar (82) may have a number of ridges (not shown) each of which runs parallel to the bar's longitudinal axis. The principle which governs holding the eyeshield (16) in a desired position works the same for ridges as it does for teeth (88), i.e., the bar (82) may be rotated until one of the ridges engages a desired notch (86) in the keeper bar (84).

While the preferred embodiments for the present invention have been described in detail, it is understood that variations in the specific descriptions contained herein still fall within the breadth and scope of this disclosure. For example, the materials used to construct the fastener components may be selected from any combination of a wide range of metals and alloys, plastic, wood, etc. Similarly, specific shapes of the fastener components should not be construed as limiting but rather are intended to include alternatives. For example, when a component is described as "generally L-shaped" it is understood that a curving rather than perpendicular joint still falls within this disclosure.

It is intended that the above descriptions of the preferred embodiments of the structure of the present invention and the description of its mounting locations are but five enabling best mode embodiments for implementing the invention. Other applications are likely to be conceived of by those skilled in the art, which applications still fall within the breadth and scope of the disclosure of the present invention. The primary import of the present invention lies in its straight forward implementation of fastening an eyeshield to the underside of a visor while permitting the eyeshield to be rotated between operative and inoperative positions in front of the wearer's face. In addition, the eyeshield may be moved closer to or further away from the wearer's face. Again, it is understood that other applications of the present invention will be apparent to those skilled in the art upon a reading of the preferred embodiments and a consideration of the appended claims and drawings.

I claim:

1. In combination, an eyeshield, a visor, and a device for fastening said eyeshield to said visor, said device comprising:

at least one base permanently attached to the underside of said visor;

connector means for engaging said base so that the relative position of said base and said connector means remains fixed unless varied by a wearer; and pivot means for coupling said eyeshield to said connector means so that said eyeshield can be positioned in an inoperative location approximately parallel to said visor, in an operative position approximately perpendicular to said visor, and at a plurality of positions therebetween;

said base further comprising an L-shaped cross-section with an upper and a lower leg, said lower leg having an upper surface and said upper leg having an interior surface made of alternating teeth and indentations;

said connector means further comprising an inverted, L-shaped member having a horizontal and a vertical leg, said connector means rests on said upper surface of said lower leg, contacts said interior surface via at least one tooth shaped to fit into said interior surface, and contains a passage parallel to said eyeshield; and said pivot means further comprising at least one U-shaped member having two upper arms, said U-shaped member attached to said eyeshield and having aligned passages in each of said two upper arms, said U-shaped member capable of receiving that portion of said connector means containing said passage such that a connecting pin can be placed through said passages.

2. The device of claim 1, wherein said alternating teeth and indentations contain only right angles.

3. The device of claim 1, wherein said alternating teeth and indentations are triangular points.

4. The device of claim 1, wherein said alternating teeth and indentations have rounded surfaces.

5. The device of claim 1, wherein said U-shaped member further comprises a slit into which a portion of said eyeshield is inserted.

6. In combination, an eyeshield, a visor, and a device for fastening said eyeshield to said visor, said device comprising:

at least one base permanently attached to the underside of said visor;

connector means for engaging said base so that the relative position of said base and said connector means remains fixed unless varied by a wearer; and pivot means for coupling said eyeshield to said connector means so that said eyeshield can be positioned in an inoperative location approximately parallel to said visor, in an operative position approximately perpendicular to said visor, and at a plurality of positions therebetween;

said base having two ends, a length, and a cross-section, said cross-section having an inverted T-shape, said base attached to said visor such that said length is perpendicular to said wearer;

said connector means is a track comprising two opposing top walls, two side walls, a track base and a hook containing a passage which form an inverted T-shaped chamber within said track in which said base fits; and said pivot means is at least one U-shaped member having two upper arms, said member attached to said eyeshield and having aligned passages in each of said two upper arms, said U-shaped member capable of receiving that portion of said hook containing said passage between said two upper arms such that a connecting pin can be placed through said passages.

7. The device of claim 6, wherein said base further comprises a stop member at each of said two ends which prevents said track from sliding off of said base.

8. In combination, an eyeshield, a visor, and a device for fastening said eyeshield to said visor, said device comprising:

at least one base permanently attached to the underside of said visor; connector means for engaging said base so that the relative position of said base and said connector means remains fixed unless varied by a wearer; and pivot means for coupling said eyeshield to said connector means so that said eyeshield can be positioned in an inoperative location approximately parallel to said visor, in an operative position approximately perpendicular to said visor, and at a plurality of positions therebetween;

said base having an L-shaped cross-section and an upper and a lower leg, said lower leg having an upper surface and said upper leg having an interior surface made of alternating teeth and indentations;

said connector means is a horizontal bar having two ends, each of said ends terminating in a U-shaped contact having a center channel shaped to house said lower leg, said channel formed by said bar, a side wall extending vertically from said bar, and a top wall perpendicular to said side wall and parallel to said bar, said top wall having an exposed end containing at least one tooth and indentation and contacting said base at said interior surface, and a hook attached to said bar opposite said U-shaped contact, said hook containing a passage parallel to said bar; and said pivot means is at least one U-shaped member having two upper arms, is attached to said eyeshield and has aligned passages in each of said two upper arms, said U-shaped member capable of receiving that portion of said hook containing said passage between said two upper arms and a connecting pin placed through said passages.

9. In combination, an eyeshield, a visor, and a device for fastening said eyeshield to said visor, said device comprising:

a base permanently attached to the underside of said visor;

connector means for engaging said base so that the relative position of said base and said connector means remains fixed unless varied by the wearer; and pivot means for coupling said eyeshield to said base so that said eyeshield can be positioned in an inoperative location approximately parallel to said visor, in an operative position approximately perpendicular to said visor, and at any position therebetween;

said base is a horizontal bar having a cross-sectional width and containing a groove and at least one hook containing a passage at each end;

said connector means further comprising mating tabs located within said visor, each of said mating tabs corresponding to and fitting into one of said grooves in said bar for attachment thereto; and said pivot means comprising at least one U-shaped member having two upper arms, said U-shaped member attached to said eyeshield and having aligned passages in each of said two upper arms, said U-shaped member capable of receiving that portion of said hook containing said passage between said two upper arms such fit a connecting pin can be placed through said passages.

10. The device of claim 9, wherein said bar is flexible.

11. The device of claim 9, wherein said mating tabs are wider than said cross-sectional width of said bar.

12. In combination, an eyeshield, a visor, and a device for fastening said eyeshield to said visor, said device comprising:

two bases permanently attached to the underside of said visor, each of said bases having an L-shaped cross-section and an upper and a lower leg, said lower leg having an upper surface containing alternating indentations;

a keeper bar attached to the underside of said visor adjacent and parallel to each of said bases, said keeper bar housing a plurality of notches along its length; and a horizontal bar having two ends and a length, said horizontal bar being attached to said eyeshield along said length, each of said ends of said horizontal bar placed in one of said indentations in each of said two bases, said ends of said horizontal bar containing a plurality of contact members which engage one of said notches to prevent said horizontal bar from rotating.

13. The device of claim 12, wherein said keeper bar is biased toward said lower leg.

14. The device of claim 12, wherein each of said notches corresponds to one of said indentations.

15. The device of claim 12, wherein said contact members are teeth.

16. The device of claim 12, wherein said contact members are ridges.

* * * * *